United States Patent [19]

DuBois et al.

[11] 4,397,461

[45] Aug. 9, 1983

[54] SORTING MACHINE

[75] Inventors: R. Clark DuBois, Fairfield; John C. Hamma, Bridgeport, both of Conn.

[73] Assignee: Gradco/Dendoki, Inc., Santa Ana, Calif.

[21] Appl. No.: 313,602

[22] Filed: Oct. 21, 1981

[51] Int. Cl.[3] ..... B65H 39/11

[52] U.S. Cl. ..... 271/293; 271/220

[58] Field of Search ..... 271/293, 218, 219, 220

[56] References Cited

U.S. PATENT DOCUMENTS

| | | | |
|---|---|---|---|
| 3,788,640 | 1/1974 | Stemmle | 271/293 |
| 4,203,587 | 5/1980 | Kishi | 271/293 |
| 4,328,963 | 5/1982 | DuBois | 271/293 |
| 4,332,377 | 6/1982 | DuBois | 271/293 |
| 4,343,463 | 8/1982 | Lawrence | 271/293 |

OTHER PUBLICATIONS

Xerox Disclosure Journal, vol. 1, No. 4, p. 59, Apr. 1976, "Sheet Sorter", Stanley Clarkson et al.

*Primary Examiner*—Richard A. Schacher

*Attorney, Agent, or Firm*—Newton H. Lee, Jr.

[57] ABSTRACT

A sorting machine has bins which are shifted sequentially past a sheet entry location between positions at opposite sides of the sheet entry location, to provide a relatively wide sheet receiving space between adjacent bins at the entry location. The bins have their outer ends pivotally mounted in a frame structure spaced from the sheet entry location, so that the bins slope forwardly. Shifting of the bins is accomplished by a reversible motor driven rotor located at one side of the bins and having recesses to receive trunnions at one side of the bins on each one-half revolution to shift a bin in one direction or the other. The other side of the bin group is unobstructed.

10 Claims, 9 Drawing Figures

(NON-SORT)

(START SORTING)

(MID SORTING)

(10th SHEET SORTING)

SORTING MACHINE

BACKGROUND OF THE INVENTION

In the pending United States patent applications of F. J. Lawrence, Ser. No. 98,191, now U.S. Pat. No. 4,343,463, and Du Bois and Hamma, Ser. No. 98,546, now U.S. Pat. No. 4,328,963, there are disclosed sorting machines, applicable to office copying machines, which are of simple, compact construction.

These sorting machines utilize a shifting bin mode of operation, wherein the bins are pivotally mounted at one end remote from the sheet entry location and actuated past the sheet entry location at the other end by rotary members which are driven in opposite directions to engage and move the bins in opposite directions.

Sorting machines of the shifting bin type are also disclosed in the following prior U.S. Pat. Nos.:

Kishi et al 4,203,587 May 20, 1980

Stemmle 3,788,640 Jan. 19, 1974

Reference is also made to the Clarkson et al disclosure of a sheet sorter in XEROX DISCLOSURE JOURNAL" Vol. 1, No. 4, page 59, April 1976.

In Kishi et al, the bins are allowed to fall past the sheet entry location by operation of a pawl mechanism. The bins are then all lifted manually or by a restoration means. The outer ends of the trays are pivotally and longitudinally slidably mounted.

In Stemmle, the bins are engaged by screw shafts at both sides of the inlet end and at the center of the other end. The screw shafts have high pitch and low pitch threads which shift the bins in unison in opposite directions to uniformly widely space the bins at the inlet and support the bins in uniformly closely spaced relation, as they are moved in opposite directions at opposite sides of the sheet entry.

In the Clarkson et al disclosure, the bins are pivotally mounted at their outer ends and are allowed by an indexing arrangement to fall through an arc to increase the space, between bins at the sheet entry location.

All of such sorters have the advantage that the large space between bins at the sheet inlet location reduces the liklihood of jamming of the incoming sheets.

SUMMARY OF THE INVENTION

The present invention relates to shifting bin sorters which are improvements in sorters of the type disclosed in the Lawrence and Du Bois and Hamma applications identified above, wherein the structure is very compact and efficient.

More particularly, the invention relates to sorters wherein the inlet ends of the bins are shifted by a simple reversible rotary member located at one side only of the bins, leaving the other side free for removal of collated sets.

In addition, the utilization of a bin shifting mechanism at one side of the trays has the advantage of precluding the possibility of binding when bins are being shifted, particularly when holding a large number of sheets, and timed, synchronous drives are not required, as in the case of multiple bin shifters engaging the bins in multiple locations, such as those shown in the above-identified application of Lawrence and of Du Bois and Hamma.

An object of the invention, therefore, is to provide a shifting bin sorting machine applicable to standard office copiers which is simple in construction and which avoids problems of space and bin binding, and which, at the same time, affords improved access to collated sets of sheets.

DESCRIPTION OF THE PREFERRED EMBODIMENT

Figure 1:
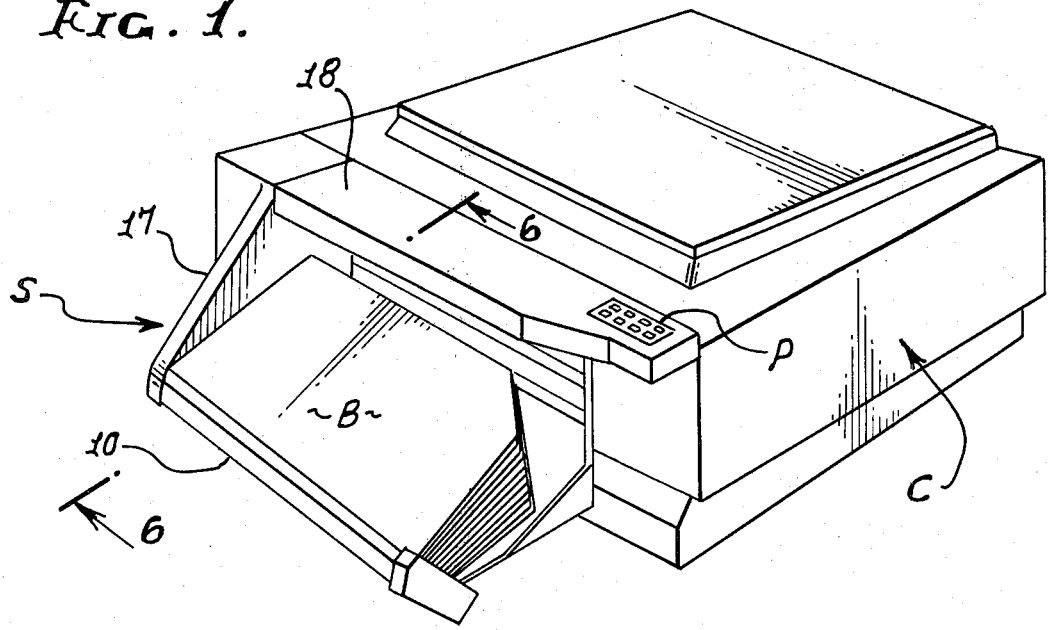
FIG. 1 is a perspective view showing a sorting machine according to the invention applied to a copying machine.

As seen in the drawings, the sorting machine S of the invention is applied to a copy machine C of a suitable type, such as a xerographic or electrostatic copier, adapted to produce plural copies of successive originals in a well known manner.

Copy sheets are discharged from the copy machine from the usual transport mechanism. In the case of the illustrated embodiment, a supplemental sheet transport means T is provided to carry the sheets (shown in broken lines in FIGS. 2 through 5) from the copy machine into the sorter bins or trays B or into a receiving tray R when the apparatus is in a "NON-SORT" mode.

As shown, the bins B and the receiving tray R are formed as plates supported in a frame structure 10 on an incline with ends 11 remote from the copier mounted on pivots 12 which are vertically spaced centers lying in a plane inclined outwardly, from bottom to top, from the copy machine.

Spring means 13 (FIG. 6) normally biases the inner ends 14 of the tray R and bins B upwardly into engagement with transfer means 15, operable by drive means 16 (FIG. 7) to shift the bin ends 14 successively upwardly or downwardly during sorting operations, the bins swinging on their horizontal pivots 12.

The frame structure 10 includes a main frame section or housing 17 containing the transport means T, spring means 13, transfer means 15 and various control instrumentalities. Operating circuit means for the drive means may be conveniently housed beneath a main frame cover 18. Beneath the main frame 17 is a mounting plate 19 having a suitable number of hanger brackets 20 to support the sorting machine on the copying machine in a simple manner enabling removal of the sorter. The hanger brackets include a hook 21 adapted to engage a cross bar 22 in the copier, and a vertical edge 23 of the bracket engages a copier frame member 24, thereby enabling the sorter to be suspended in proper relation to the sheet outlet transport 25 of the copier.

Figure 6:
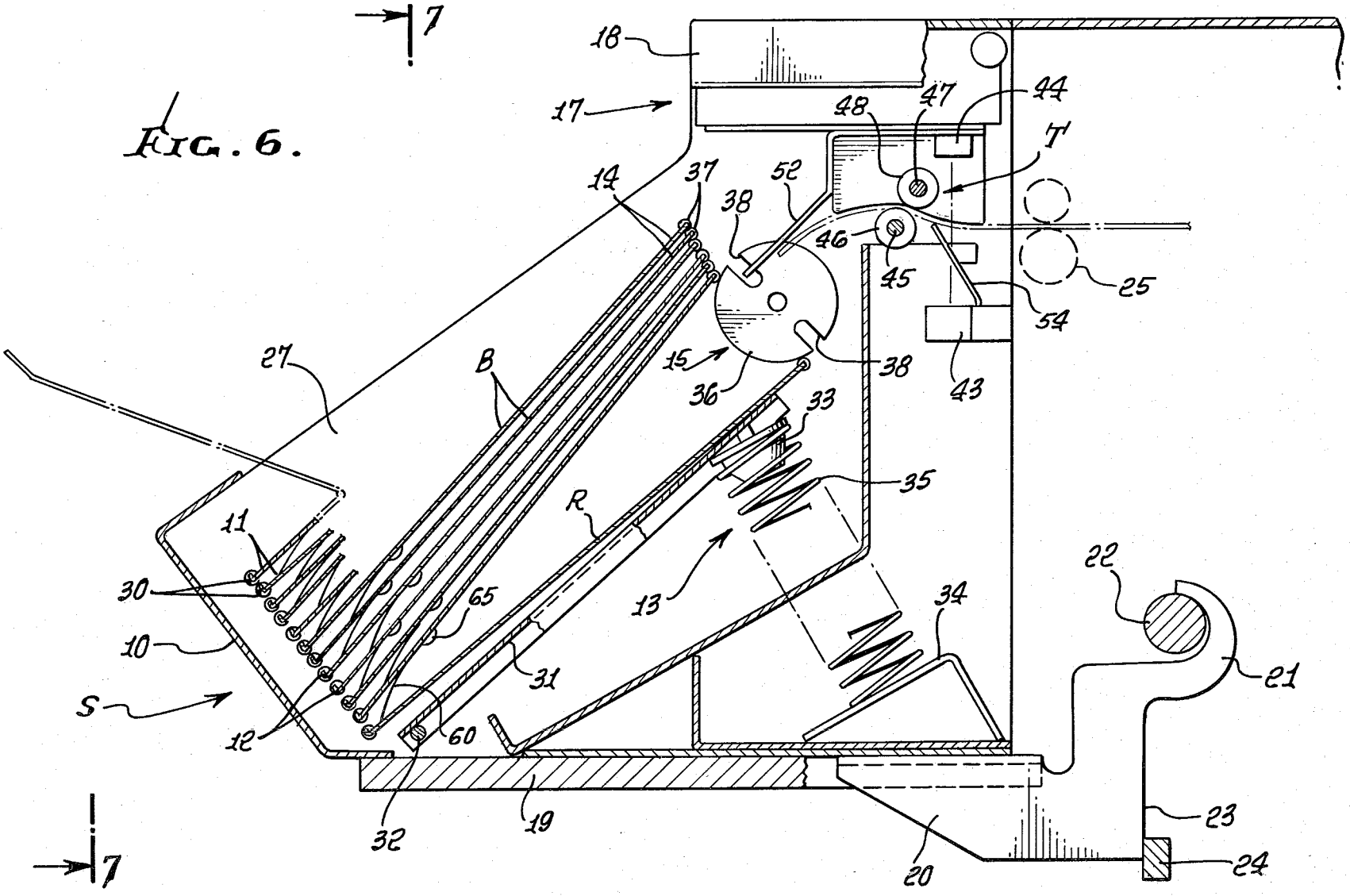
FIG. 6 is an enlarged vertical section, as taken on the line 6—6 of FIG. 1 showing the details of the sorting machine.

Extending upwardly from the base plate are laterally spaced front and rear walls 27 and 28. The outer ends 11 of the bins B and the tray R have their pivots 12 supported in the opposed front and rear walls. In a simple manner, as shown, each bin or tray has laterally projecting pivot pins 29 extending through holes 30 in the respective side walls. Referring to FIG. 6, the disposition of the pivots 12 on an inclined plane will cause sets of copies in the bins to be longitudinally offset with respect to one another.

Spring means 13 are located adjacent to the rear wall 28 and comprises a plate 31 pivoted at 32 on the rear wall 28 of the frame structure below the receiving tray R. At it's inner free end, the plate 31 is provided with a spring seat 33 and an opposing spring seat 34 is provided at the base of the frame structure. A coiled compression spring 35 is positioned between and engaged with the seats 33 and 34 to provide an upward bias to the plate 31. Thus, the spring means 13 acts to urge the receiving tray R and the bins B upwardly when the bins are below the transfer means 15.

Figure 7:
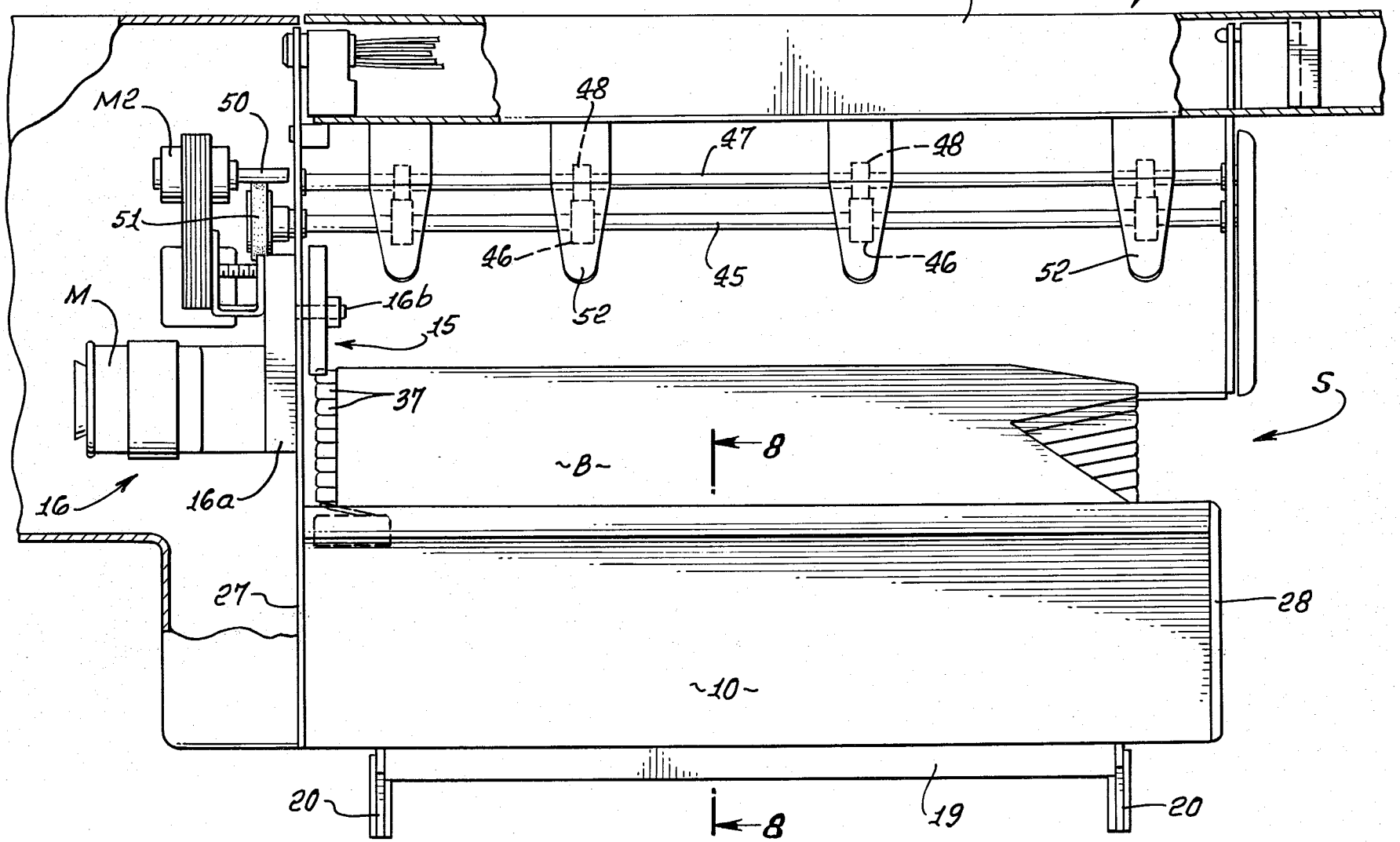
FIG. 7 is a horizontal section, as taken on the line 7—7 of FIG. 6.

Transfer means 15, in the embodiment shown, includes what we characterize as a Geneva wheel 36 driven by motor means M and a gear 11*a* to engage and shift successive bins B between a position at one side or below the sheet entry location and a position at the other side or above the sheet entry location, depending upon the direction of rotation of the Geneva wheel 36. As seen in FIGS. 6 and 7, each bin, adjacent to its inner end 14 has a laterally projecting drive lug or trunnion 37. Geneva wheel, 36 has one or more radially outwardly opening notches 38, two being shown, providing opposed walls to receive and engage the trunnions 37 of successive bins upon rotary movement of the wheel 36, whereby the bins are shifted upwardly and downwardly, as described above.

Utilization of the single transfer member at only one side of the bins are certain advantages, as compared with the Geneva wheels at both sides of the bin, as in our prior application referred to above, and as compared with helical cams as disclosed in the above identified application of Lawrence. More specifically, this single Geneva wheel structure enables the use of simple drive means 16 with the wheel 36 mounted on the output shaft 16*b* from the gear box. In addition, tendency of the bin ends to bind in a spaced pair of drive elements is avoided.

A switch or detector device is provided to cooperate with the transfer wheel 36 to control the motor M in a manner causing the wheel to be rotated one-half revolution per bin shifting function. In the event that the transfer wheel has only one notch 38, then the motor will be stopped on each full revolution. Such a control needs no further description herein, and reference may be made to the above-identified applications for suitable controls.

The controls also include a sheet detector 43, see FIG. 6, such as a photo electric cell device 43 responsive to a light source 44 adjacent to the transport means T to interrupt operation of motor M during the period that a sheet, shown in broken lines, is being transported into a sorter bin or tray, depending upon the mode of operation of the sorter. The function of the sheet detector is to cause an activating signal for the motor M, whereby, in the sorting mode of operation the transfer wheel is rotated one-half revolution following the passage of a sheet through the sheet detector. Suitable additional controls would include motor reversing switches to shift the bins in opposite directions after a desired number of bins have been transferred upwardly or downwardly.

The transport means T, referring to FIGS. 6 and 7, comprises a driven shaft 45 having feed rolls 46 thereon, and and upper shaft 47 having pinch rolls 48 thereon. These shafts are suitably journalled in the frame structure. The upper shaft may be loaded downwardly to cause engagement of the pinch rolls with the drive rolls. The drive for the drive rolls includes a motor M2, having an output shaft 50 frictionally engaging a resilient driven wheel 51 which is connected to the driven shaft 45 of the transport. Thus, the transport T cannot apply excessive tension on the sheet tending to pull the sheet from the transport 25 of the copying machine.

As sheets are discharged from the transport, the leading edge is deflected downwardly towards the downwardly sloping trays, as seen in FIGS. 6 and 7, by a number of laterally spaced deflectors 52 which extend downwardly towards the open trays. In some configurations, a sheet inlet deflector 54 may also be employed to direct sheets to the transport T.

Figure 8:
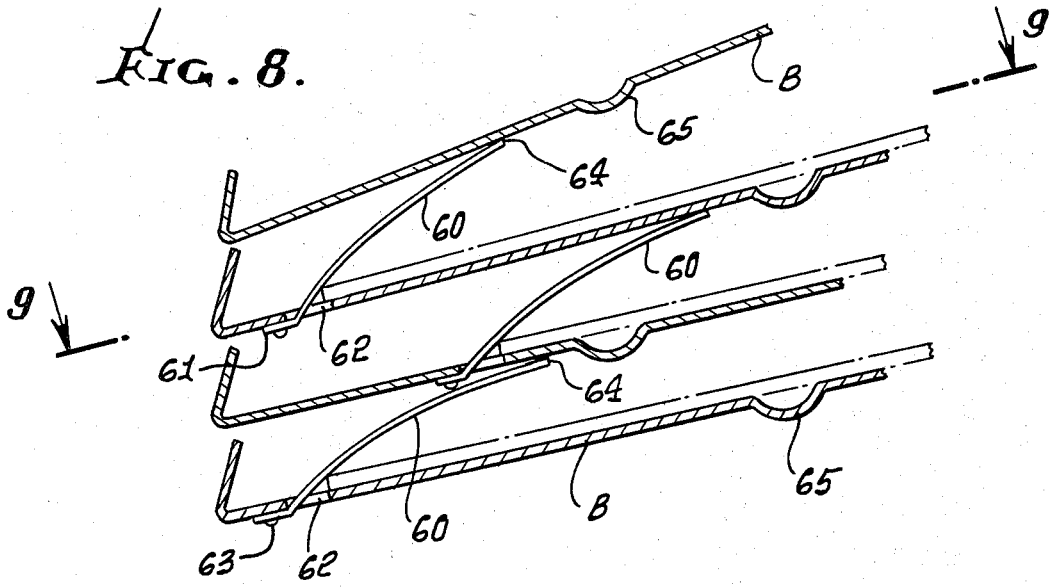
FIG. 8 is a fragmentary detail section, as taken on the line 8—8 of FIG. 7.
Figure 9:
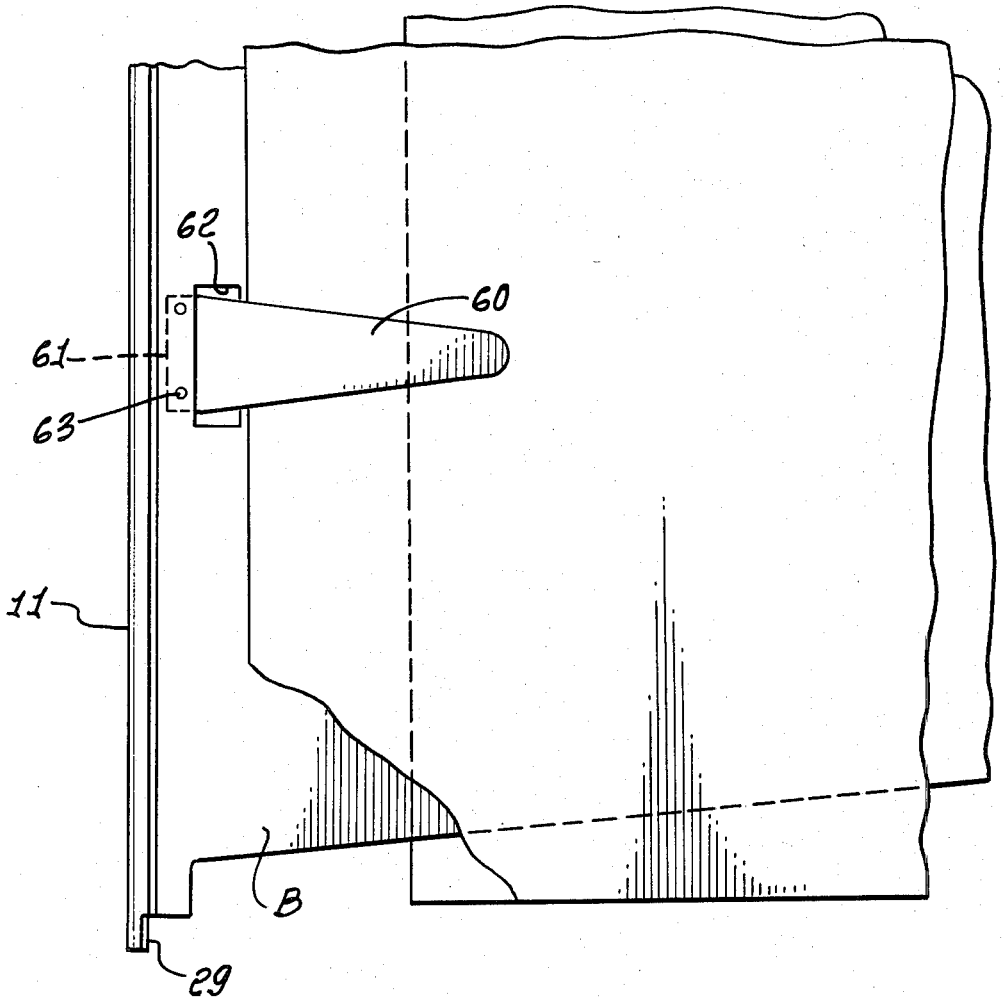
FIG. 9 is a horizontal section, as taken on the line 9—9 of FIG. 8.

In the preferred form illustrated, means are provided, as seen in FIGS. 8 and 9, to arrest downward movement of sheets in a manner which minimizes rebound, so that each set of sheets will be neat and aligned. Each tray is provided with a pair of laterally spaced light spring fingers 60 having an attachment end 61 extending downwardly through a slot 62 in the tray and secured to the underside of the tray as by welding or rivets 63. Each spring is arched upwardly and has a free end 64 slidably engaged with the underside of the tray above, whereby the trays can be pivoted to the opened and closed positions and the spring ends 64 remain in engagement with the superjacent tray. To avoid engagement of a leading edge of a sheet with a spring end 64, the trays are provided with downwardly protruding dimples 65 at locations aligned with the springs and shielding the ends of the springs. As shown, the springs on alternate trays are longitudinally offset. Thus, alternate sets of sheets will be longitudinally offset for ease of removal from the bins.

OPERATION

In the use of the sorting machine described above, the mode of operation can be selected at a suitable control panel P seen in FIG. 1.

Figure 2:
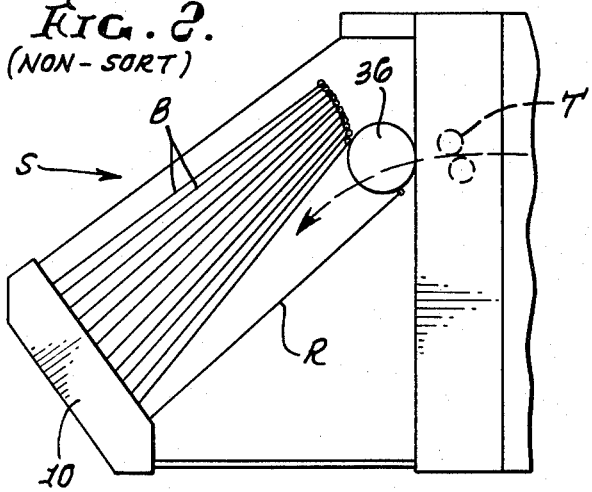
FIG. 2 is a fragmentary side elevation showing the sorting machine in a "NON-SORT" condition for receiving one or a plurality of copies.
Figure 3:
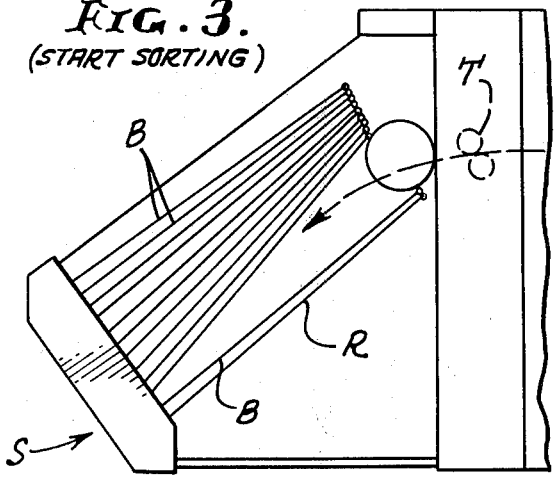
FIG. 3 is a view corresponding to FIG. 2, but showing the sorting machine in a "START SORTING" condition.
Figure 4:
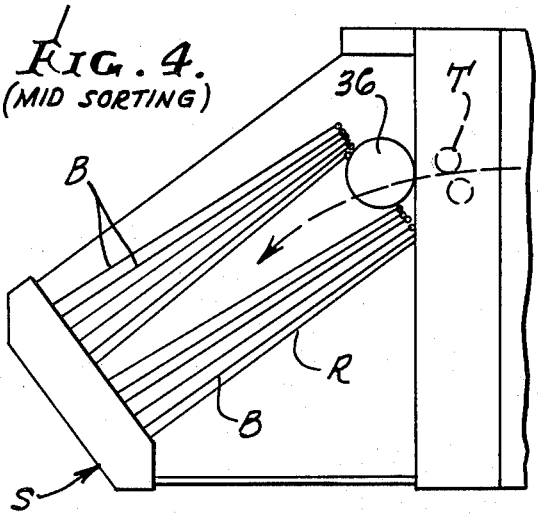
FIG. 4 is a further view corresponding with FIG. 2, but showing the sorting machine in a "MID SORTING" condition.

In the non sort mode shown in FIG. 2, any selected number of copies of an original are supplied to the receiving tray R from the copier. Under these conditions, all of the bin trays B are in an upper position, supported one on the other and with the trunnion 37 of the lowermost bin supported on the periphery of the Geneva wheel 36.

Figure 5:
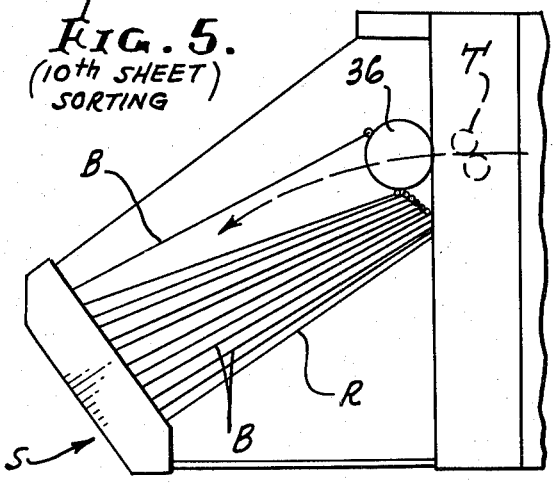
FIG. 5 is another view corresponding with FIG. 2, showing the sorting machine in a "10TH SHEET SORTING" condition.

When a number of sheets are to be sorted, an operator selects the number, at panel P, up to ten in the illustrated embodiment. Under suitable control, the transfer wheel will shift one bin tray downwardly about the pivot 12, into engagement with the receiver tray R, forcing the latter downwardly against the upward bias of the spring 35. As successive sheets pass the sheet detector 43 successive bins are moved downwardly, further depressing the spring 35. The tenth sorted sheet is deposited between the uppermost bin plate, as seen in FIG. 5, and the uppermost bin tray B.

Thereupon, the operation will be reversed as second sheets are sorted and the spring 33 urges the trays successively upwardly for engagement by the transfer wheel 36.

With the single transfer wheel, at one side of the trays, at the rear of the sorter the bins are easily accessible for removal of collated sets of sheets.

From the foregoing, it will be appreciated that a novel sheet sorter is provided for use with copying machines wherein the structure and arrangement of parts have been simplified and access to the sets of sheets is facilitated by virtue of the arrangement of the bin shifting mechanism at the rear of the sorter, and synchronous driving and possible binding of the bins have been avoided.

We claim:

1. An improved sorting apparatus comprising:

a frame structure; a plurality of bin members pivotally mounted on said frame structure at one end of said bin members; means for successively pivotally moving the other ends of said bin members between first and second positions at which said other ends of said bin members are above and below a sheet entry location and in closely spaced relation and widely spacing successive bin members at said entry location; said from structure including a rear support wall and an open front wall; drive means on said rear wall; a rotary bin shifting member driven by said drive means and having a recess to engage and pivotally move successive bin members upon rotation in either direction; said bin members having trunnions engageable with said bin shifting member to be widely spaced at said entry location, and spring means to bias said bin members toward said bin shifting member in at least an upward direction.

2. An improved sorting apparatus as defined in claim 1; said bin shifting member being a Geneva wheel, said drive means including a driven shaft extending through said rear wall; said Geneva wheel being mounted on said shaft.

3. An improved sorting apparatus as defined in claim 1; said spring means including a spring acting between said frame structure and the underside of said bin members at said other ends of said bin members.

4. An improved sorting apparatus as defined in claim 1; including sheet transport means in said frame structure for moving a sheet into said bin members at said entry location; said transport means including a driven shaft journalled between said rear and front walls and having sheet drive means thereon; pinch means for urging a sheet into frictional engagement with said sheet drive means; and means for driving said driven shaft including a motor and a friction drive between said motor and driven shaft.

5. An improved sorting apparatus as defined in claim 1; including a receiver tray having one end pivotally mounted in said frame structure below said other ends of said bin members; said spring means being disposed between said receiver tray and said frame structure adjacent the end of said receiver tray adjacent to said entry location.

6. An improved sorting apparatus is defined in claim 1; said bin members being pivoted on horizontal axes disposed in horizontally spaced relation, and including stop means on said bin members to arrest movement of sheets into said bin members with sets of said sheets horizontally displaced.

7. An improved sorting apparatus as defined in claim 6; said stop means including spring elements mounted on the respective bin members and extending upwardly towards said sheet entry location into resilient engagement with a superjacent bin member.

8. An improved sorting apparatus as defined in claim 6; said stop means including spring elements mounted on the respective bin members and extending upwardly towards said sheet entry location into resilient engagement with a superjacent bin member; said spring elements on adjacent bin members being longitudinally staggered.

9. An improved sorting apparatus as defined in claim 6; said stop means including spring elements mounted on the respective bin members and extending upwardly towards said sheet entry location into resilient engagement with a superjacent bin member, and projections on the underside of said superjacent bin members shielding said ends of said spring elements against engagement by the leading edge of incoming sheet.

10. An improved sorting apparatus as defined in claim 1; said bin shifting member being a Geneva wheel, said drive means including a driven shaft extending through said rear wall; said Geneva wheel being mounted on said shaft, and also including sheet transport means in said frame structure for moving a sheet into said bin members at said entry location; said transport means including a driven shaft journalled between said rear and front walls and having sheet drive means thereon; pinch means for urging a sheet into frictional engagement with said sheet drive means; and means for driving said driven shaft including a motor and a friction drive between said motor and driven shaft.

* * * * *